US008206118B2

(12) United States Patent
Propheter-Hinckley et al.

(10) Patent No.: US 8,206,118 B2
(45) Date of Patent: Jun. 26, 2012

(54) AIRFOIL ATTACHMENT

(75) Inventors: Tracy A. Propheter-Hinckley, Manchester, CT (US); Michael G. McCaffrey, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 1445 days.

(21) Appl. No.: 11/969,363

(22) Filed: Jan. 4, 2008

(65) Prior Publication Data

US 2010/0284816 A1 Nov. 11, 2010

(51) Int. Cl.
*F01D 5/14* (2006.01)

(52) U.S. Cl. ..... 416/219 R; 416/220 R; 416/230; 416/241 B; 416/248

(58) Field of Classification Search ..... 416/219 R, 416/220 R, 223 A, 229 R, 230, 241 B, 248
See application file for complete search history.

(56) References Cited

U.S. PATENT DOCUMENTS 2,656,146 A * 10/1953 Sollinger ..... 416/92
4,037,990 A * 7/1977 Harris ..... 416/220 R
4,152,488 A 5/1979 Schilke et al.
4,417,854 A * 11/1983 Cain et al. ..... 416/241 B
4,725,200 A * 2/1988 Welhoelter ..... 416/221
4,921,405 A 5/1990 Wilson
5,118,257 A 6/1992 Blakeley et al.
5,222,297 A 6/1993 Graff et al.
5,240,375 A * 8/1993 Wayte ..... 416/219 R
5,240,377 A 8/1993 Farr
5,292,231 A * 3/1994 Lauzeille ..... 416/229 A
5,340,280 A 8/1994 Schilling
5,346,367 A 9/1994 Doolin et al.
5,378,110 A 1/1995 Ress, Jr.
6,004,101 A 12/1999 Schilling et al.
6,290,466 B1 9/2001 Ravenhall et al.
6,607,358 B2 8/2003 Finn et al.
6,758,653 B2 7/2004 Morrison
6,857,856 B2 2/2005 Potter et al.
7,300,255 B2 * 11/2007 Potter et al. ..... 416/229 R
2007/0258811 A1 11/2007 Shi et al.

* cited by examiner

*Primary Examiner* — Igor Kershteyn
(74) *Attorney, Agent, or Firm* — Carlson, Gaskey & Olds PC

(57) ABSTRACT

A rotor blade for a gas turbine engine includes an airfoil that extends in span between a tip and a root opposite from the tip. The root includes a plug, a looped portion that surrounds the plug and a clamp. The clamp contacts only a portion of the looped portion on an opposite side of the looped portion from the plug.

11 Claims, 4 Drawing Sheets

AIRFOIL ATTACHMENT

BACKGROUND OF THE INVENTION

This disclosure relates generally to a gas turbine engine, and more particularly to an attachment for a composite rotor blade of a gas turbine engine.

Gas turbine engines, such as turbofan gas turbine engines, typically include a fan section, a compressor section, a combustor section and a turbine section. During operation, air is pressurized in the compressor section and mixed with fuel in the combustor section for generating hot combustion gases. The hot combustion gases flow through the turbine section which extracts energy from the hot combustion gases to power the compressor section and drive the fan section.

Gas turbine engines typically include a plurality of rotating blades that either add energy to the airflow communicated through the engine or extract energy from the airflow. For example, the turbine section of the gas turbine engine includes a plurality of rotor blades that extract the energy from the hot combustion gases communicated through the turbine section to power the compressor section and the fan section. The rotor blades typically include an airfoil section and a root section that is mounted to a rotating disk. The root section may include a "fir-tree" shape, and the rotating disk may include a slot having a corresponding "fir-tree" shape for receiving the root section.

Gas turbine engine rotor blades made from composite materials are known and can provide significant weight and cooling air savings. Composite rotor blades have a high strength to weight ratio that allows for the design of low weight parts able to withstand extreme temperatures and loading associated with a gas turbine engine.

One drawback to composite rotor blades is that since the blades are often made of a laminated fiber or filament reinforced composite material, and the rotor disks are typically made from a metallic material, the transfer of forces and loads between the rotor blades and the rotating disk may damage the root section of the rotor blade. In addition, the machining of a traditional "fir-tree" shape on the root section may compromise the strength of a composite rotator blade when using composite materials, such as fabric materials and/or fibers which are layered and glued together with a matrix material.

Accordingly, it is desirable to provide an improved composite rotor blade that is high in strength and provides adequate attachment to a rotating disk.

SUMMARY OF THE INVENTION

A rotor blade for a gas turbine engine includes an airfoil that extends in span between a tip and a root opposite from the tip. The root includes a plug, a looped portion and a clamp. The looped portion surrounds the plug. The clamp contacts only a portion of the looped portion on an opposite side of the looped portion from the plug.

A gas turbine engine includes a compressor section, a combustor section and a turbine section. A rotor disk is positioned within one of the compressor section and the turbine section and includes a plurality of slots. A plurality of rotor blades include an attachment portion that is received within one of the plurality of slots. The attachment portion includes a plug, a looped portion that surrounds the plug, and at least one clamp that only partially contacts the looped portion.

A method for providing a composite rotor blade having an attachment portion including a plug, a looped portion and a clamp for a gas turbine engine includes surrounding the plug with the looped portion, and positioning the clamp such that the clamp only partially contacts the looped portion.

The various features and advantages of this disclosure will become apparent to those skilled in the art from the following detailed description. The drawings that accompany the detailed description can be briefly described as follows.

DETAILED DESCRIPTION OF THE PREFERRED EMBODIMENT

Figure 1:
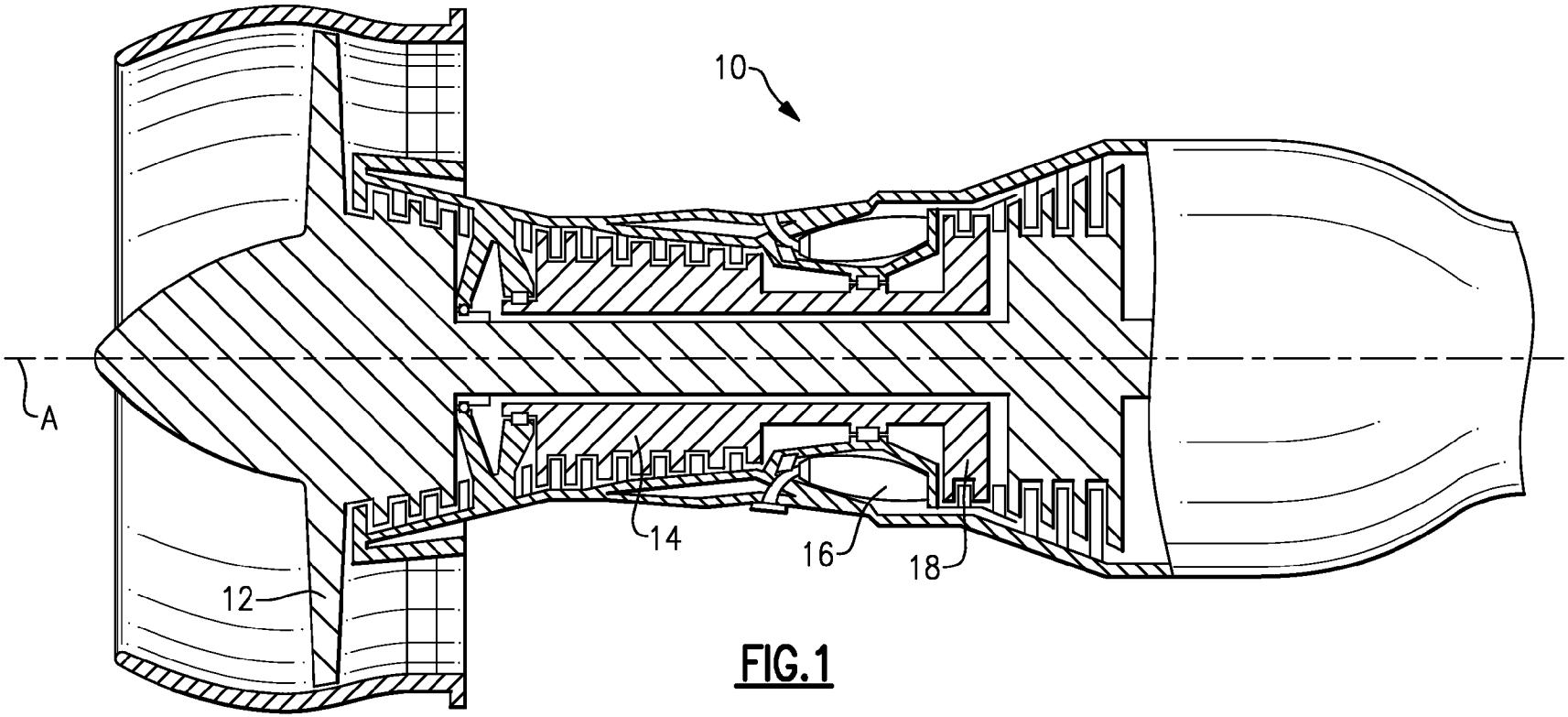
FIG. 1 is a cross-sectional view of an example gas turbine engine.

FIG. 1 illustrates an example gas turbine engine 10 that includes a fan section 12, a compressor section 14, a combustor section 16 and a turbine section 18. The gas turbine engine 10 is defined about an engine centerline axis A about which the various engine sections rotate. As is known, air is drawn into the gas turbine engine 10 by the fan section 12 and flows through the compressor section 14 to pressurize the airflow. Fuel is mixed with the pressurized air and combusted within the combustor section 16. The combustion gases are discharged through the turbine section 18 which extracts energy therefrom for powering the compressor section 14 and a fan section 12. Of course, this view is highly schematic. In one example, the gas turbine engine 10 is a turbofan gas turbine engine. It should be understood, however, that the features and illustrations presented within this disclosure are not limited to a turbo fan gas turbine engine. That is, the present disclosure is applicable to any engine architecture.

Figure 2:
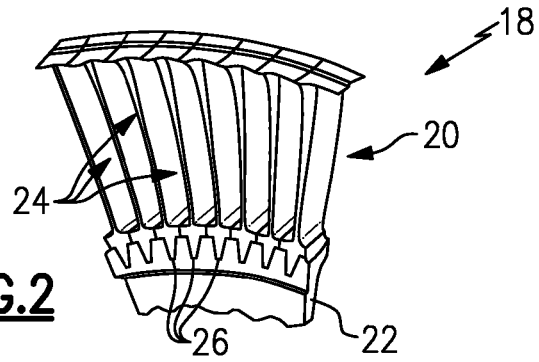
FIG. 2 illustrates a portion of a turbine section of the example gas turbine engine illustrated in FIG. 1.

FIG. 2 schematically illustrates a portion of the turbine section 18 of the gas turbine engine 10. In this example, a rotor blade assembly 20 is illustrated. The rotor blade assembly 20 includes a rotor disk 22 and a plurality of rotor blades 24. The plurality of rotor blades 24 are received within slots 26 of the rotor disk 22. The rotor blades 24 rotate about the engine centerline axis A in a known manner to extract energy from the hot combustion gases communicated through the turbine section 18 for powering the compressor section 14 and the fan section 12. In one example, the rotor blades 24 are composite turbine rotor blades.

The rotor blades 24 include unique attachment features for mounting the rotor blades 24 to the rotor disk 22, as is further discussed below. Although the examples and illustrations presented herein with respect to the unique attachment features are discussed in relation to turbine rotor blades, it should be understood that the features and advantages of this disclosure are applicable to various other components of the gas turbine engine 10 such as the fan.

Figure 3:
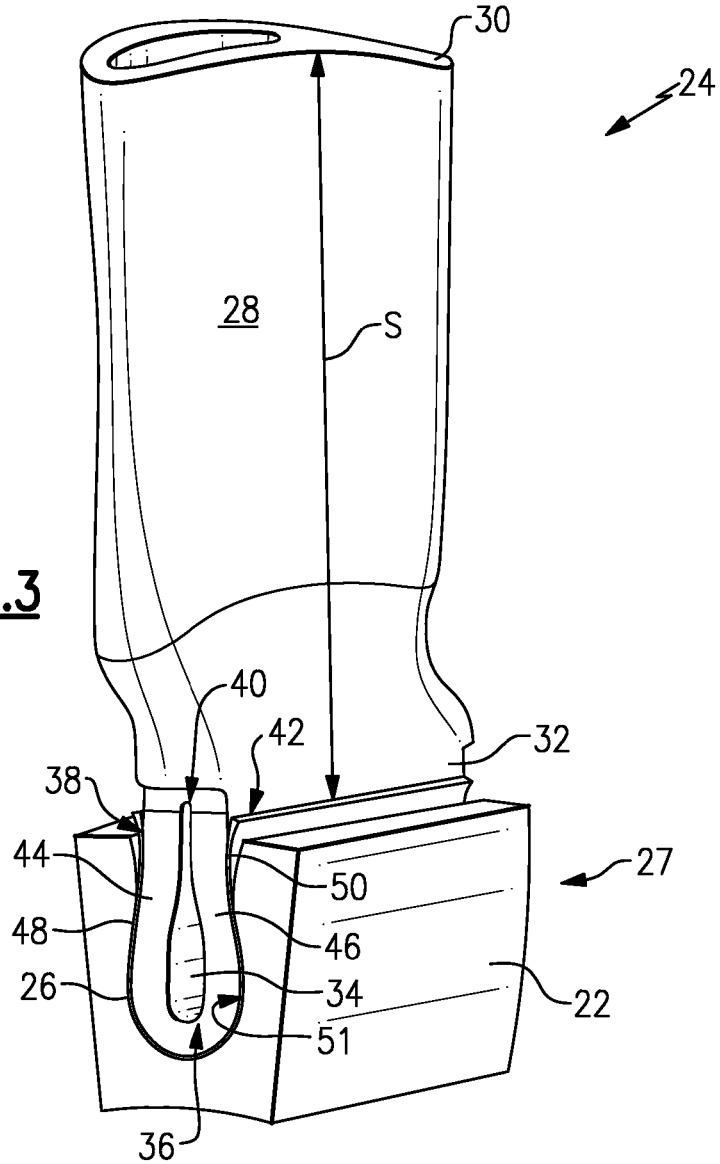
FIG. 3 illustrates a schematic view of an example rotor blade having a unique attachment portion.

FIG. 3 illustrates a rotor blade 24 having an example attachment portion 27 for connecting the rotor blade 24 to a rotor disk 22, for example. The rotor blade 24 includes an airfoil 28 that extends in span S between a tip 30 and a root 32. In one example, the rotor blade 24 is a composite turbine rotor blade. For example, the airfoil 28 is made of a ceramic matrix composite (CMC) that provides significant weight and cooling air savings to each rotor blade 24. A person of ordinary skill in the art having the benefit of this disclosure would be able to select an appropriate CMC to construct the airfoil 28. For example, the CMC may include a woven fabric made from Silicone, Carbon and a matrix material.

The example attachment portion 27 of the rotor blade 24 includes a plug 34, a looped portion 36 and a clamp 38. In one example, the plug 34 is generally teardrop shaped. However, other plug 34 shapes are contemplated as within the scope of this disclosure. The plug 34 is made of a metallic material, such as a titanium alloy, in one example. In another example, the plug 34 is made from a ceramic material. In yet another example, a CMC is utilized to construct the plug 34. A person of ordinary skill in the art having the benefit of this disclosure would be able to select an appropriate material for the plug 34.

A radial outward end 40 of the plug 34 extends radially outward of a distal end 42 of the clamp 38. The example configuration distributes the compression loads experienced by the attachment portion 27 of the rotor blade 24 over a greater area to reduce the susceptibility of the attachment portion 27 to damages caused by the compression loads.

The looped portion 36 surrounds the plug 34. In one example, the looped portion 36 completely encompasses the plug 34. The looped portion 36 is formed integrally with the root 32 of the rotor blade 24. That is, the looped portion 36 and the airfoil 28 are a single piece construction. The looped portion 36 extends radially inward from the root 32 and includes a first arm 44 and a second arm 46. The first arm 44 and the second arm 46 of the looped portion 36 extend in opposing directions to surround the plug 34. The looped portion 36 is made of a CMC, in one example.

The clamp 38 is positioned on an opposite side of the looped portion 36 from the plug 34. The clamp 38 contacts only a portion of the looped portion 36. That is, the clamp 38 does not entirely surround the looped portion 36. In one example, the clamp 38 contacts the looped portion 36 over an area that is less than 360 degrees.

In one example, the clamp 38 is a 2-piece design and includes a first clamp layer 48 and a second clamp layer 50. The first clamp layer 48 and the second clamp layer 50 are positioned on opposing sides of the looped portion 36 of the attachment portion 27. That is, the first clamp layer 48 contacts the first arm 44 of the looped portion 36, and the second clamp layer 50 contacts the second arm 46 of the looped portion 36. The clamp layers 48, 50 are sandwiched between an inner wall 51 of the rotor disk 22 and the looped portion 36 where the rotor blade 24 is received within the slot 26.

Figure 4:
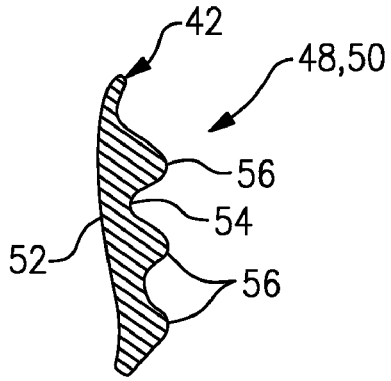
FIG. 4 illustrates an example clamp of an attachment portion of a rotor blade.
Figure 5:
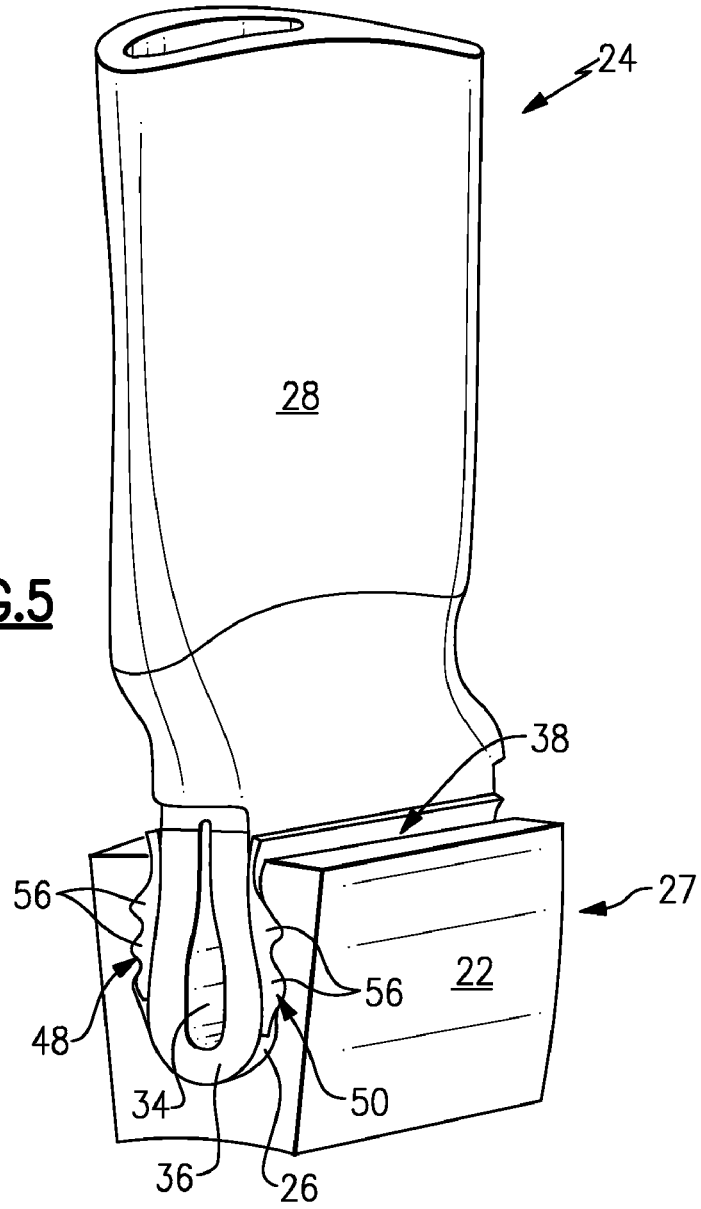
FIG. 5 illustrates a schematic view of another example rotor blade having a unique attachment portion.

Referring to FIG. 4, each of the first clamp layer 48 and the second clamp layer 50 include an inner surface 52 and an outer surface 54. The inner surfaces 52 of the clamp layers 48, 50 are contoured to generally conform to the shape of the looped portion 36, in this example. The outer surfaces 54 of the clamp layers 48, 50 are machined with a tooth 56 (or a plurality of teeth 56) to interact with the corresponding shape of the slot 26 of the rotor disk 22. In another example, the outer surfaces 54 of the clamp layers 48, 50 include a plurality of teeth 56 that interact with a traditional "fir-tree" shaped slot 26 of a rotor disk 22 (See FIG. 5). It should be understood that the outer surfaces 54 may include any number of teeth depending on design specific parameters including, but not limited to, the slot design of the rotor disk.

In one example, the clamp 38 is made of a metallic material. However, other materials are contemplated as within the scope of this disclosure. The relatively complex shape of the teeth 56 may be machined to closer tolerances, and the clamp 38 can tolerate the high, local stresses associated with interaction of the teeth 56 with the rotor disk 22 by utilizing a strong, durable material such as a metal. The clamp layers 48, 50 are glued to the looped portion 36, in one example. For example, the first clamp layer 48 is glued to the first arm 44 of the looped portion 36 and the second clamp layer 50 is glued to the second arm 46 of the looped portion.

The distal ends 42 of the clamp layers 48, 50 are curved in a direction away from the looped portion 36. This curved feature, in combination with the extension of the radial outward end 40 of the plug 34 radially outward from the distal end 42 of the clamp 38, uniformly distributes the compression loads experienced by the attachment portion 27.

Figure 6:
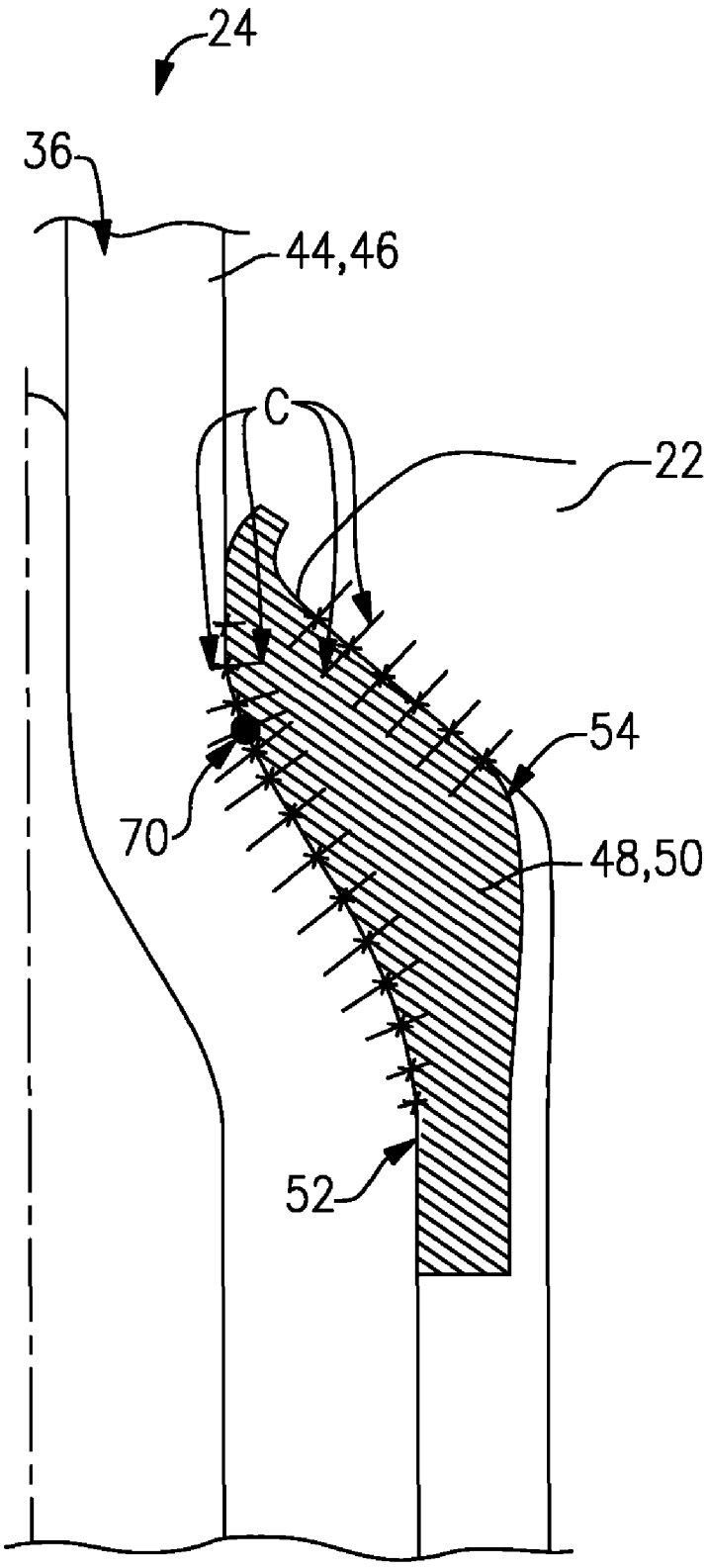
FIG. 6 illustrates the compression forces experienced by an example attachment portion of a rotor blade.

Referring to FIG. 6, a plurality of compression forces C act upon the attachment portion 27 of the rotor blade 24. For example, compression forces C are created by the interaction between of each clamp layer 48, 50 and the first and second arms 44, 46, respectively, at the inner surface 52 of each clamp layer 48, 50. In addition, the interaction between the rotor disk 22 and the outer surface 54 of each clamp layer 48, 50 creates compression forces C.

The clamp layers 48, 50 are shaped to communicate the compression forces C through a fillet area 70 of each arm 44, 46 of the looped portion 36. Communicating the compression forces C through the fillet area 70 more securely attaches the rotor blade 24 to the rotor disk 22 and creates favorable stress interaction between the parts. In one example, at least a portion of the compression forces C act upon the first and second arms 44, 46 of the looped portion 36 at a position outboard from the fillet area 70. It should be understood that the actual positioning of the fillet area 70 with respect to the first and second arms 44, 46 of the looped portion 36 and the compression forces C will vary depending upon design specific parameters including, but not limited to, the strength capabilities of the looped portion 36.

The foregoing disclosure shall be interpreted as illustrative and not in any limiting sense. A worker of ordinary skill in the art would understand that certain modifications would come within the scope of this disclosure. For these reasons, the following claims should be studied to determine the true scope and content of this disclosure.

What is claimed is:

1. A rotor blade for a gas turbine engine, comprising:

an airfoil that extends in span between a tip and a root opposite from said tip;

said root includes a plug, a looped portion that surrounds said plug and at least one clamp that contacts only a portion of said looped portion on an opposite side of said looped portion from said plug, wherein said at least one clamp is a separate and distinct structure from any portion of the rotor blade; and wherein said looped portion extends radially inwardly from said root and includes a first arm and a second arm that partially extend in opposing directions to surround said plug, wherein said at least one clamp includes an inner surface and an outer surface, and said outer surface includes at least one tooth.

2. The rotor blade as recited in claim 1, wherein said plug is generally teardrop shaped.

3. The rotor blade as recited in claim 1, wherein the rotor blade is a composite turbine blade.

4. The rotor blade as recited in claim 1, wherein said plug is made of at least one of a metal, a ceramic and a ceramic matrix composite, said looped portion is made of a ceramic matrix composite, and said at least one clamp is made of a metal.

5. The rotor blade as recited in claim 1, wherein said looped portion is formed integrally with said root.

6. The rotor blade as recited in claim 1, wherein said at least one clamp includes a first clamp layer and a second clamp layer, and said first clamp layer contacts said first arm of said looped portion and said second clamp layer contacts said second arm of said looped portion.

7. The rotor blade as recited in claim 1, wherein said outer surface includes a plurality of teeth.

8. The rotor blade as recited in claim 1, wherein at least a portion of said plug extends radially outboard of a distal end of said at least one clamp.

9. The rotor blade as recited in claim 1, wherein a distal end of said at least one clamp is curved in a direction away from said looped portion.

10. A rotor blade for a gas turbine engine, comprising:

an airfoil that extends in span between a tip and a root opposite from said tip; and said root includes a plug, a looped portion that surrounds said plug and at least one clamp that contacts only a portion of said looped portion on an opposite side of said looped portion from said plug, wherein said at least one clamp includes an inner surface and an outer surface, and said outer surface includes at least one tooth.

11. A rotor blade for a gas turbine engine, comprising:

an airfoil that extends in span between a tip and a root opposite from said tip;

said root includes a plug, a looped portion that surrounds said plug and at least one clamp that contacts only a portion of said looped portion on an opposite side of said looped portion from said plug, wherein said at least one clamp is a separate and distinct structure from any portion of the rotor blade; and wherein said at least one clamp includes an inner surface and an outer surface, and said outer surface includes at least one tooth.

* * * * *